US006388570B1

(12) United States Patent
Göggelmann

(10) Patent No.: US 6,388,570 B1
(45) Date of Patent: May 14, 2002

(54) METHOD OF SENDING AN EMERGENCY MESSAGE

(75) Inventor: Thomas Göggelmann, Gerstetten (DE)

(73) Assignee: Nokia Mobile Phones Ltd., Espoo (FI)

( * ) Notice: Subject to any disclaimer, the term of this patent is extended or adjusted under 35 U.S.C. 154(b) by 0 days.

(21) Appl. No.: 09/563,521

(22) Filed: May 3, 2000

(30) Foreign Application Priority Data

May 5, 1999 (DE) ..... 199 20 502

(51) Int. Cl.[7] ..... G08B 29/00

(52) U.S. Cl. ..... 340/514; 340/506; 340/539

(58) Field of Search ..... 340/506, 514, 340/531, 539

(56) References Cited

U.S. PATENT DOCUMENTS 4,717,904 A 1/1988 Murakami ..... 340/436
5,027,383 A * 6/1991 Sheffer ..... 379/39

FOREIGN PATENT DOCUMENTS

CH 627601 A5 1/1982
DE 19753686 6/1998

OTHER PUBLICATIONS

European Search Report dated Apr. 6, 2001 (3pp).

* cited by examiner

*Primary Examiner*—Daryl Pope
(74) *Attorney, Agent, or Firm*—Ware, Fressola, Van Der Sluys & Adolphson LLP

(57) ABSTRACT

The invention concerns a method of sending an emergency message, particularly the improvement of such methods. It is known in the state of the art to automatically transmit emergency messages to a remote station in case of an emergency situation, and/or an attempt is made to establish voice contact with the persons who are affected by the emergency. Since it is possible that the sound detection devices 17 and/or the sound emission devices 12 are damaged during an emergency situation, eliminating at least partially any advantageous communication with the remote station, the need exists to provide a method which uses any devices that are still operative after an emergency to optimally receive a communication. This objective is achieved in that after the emergency a test is performed to find out if at least one sound detection device 17 and/or at least one sound emission device 12 is still able to operate, and the result of the test is transmitted to the remote station in addition to the emergency message. This ensures that the remote station is informed of the condition of the sound emission 12 or the sound detection devices 17. This information enables the remote station to use the still available devices for a useful communication.

11 Claims, 3 Drawing Sheets

METHOD OF SENDING AN EMERGENCY MESSAGE

TECHNICAL AREA

The invention concerns a method of sending an emergency message, particularly the improvement of such methods.

STATE OF THE ART

It is known in the state of the art that emergency messages are automatically transmitted to a remote station when an emergency occurs. Such a device is described in DE-A-197 21 829 for example. In addition to the information that an emergency message is being sent to a remote station, the message also provides the alternative of establishing a voice contact with the remote station. WO 95/00860, which begins with an emergency message emitted from an automobile, also indicates that it would be very useful to establish a voice contact, for example via a telephone connection between the station sending the emergency message and the remote station. This is especially so because the voice contact for example can have a calming effect on the automobile passengers. In addition, important information for the rescue can be gained if one of the passengers is still responsive.

Since it is very possible that sound detection and/or sound emission devices suffer damage during an emergency situation, thereby at least partially excluding any advantageous communication with the remote station, the need exists for a method which optimally uses any communication devices that are still available after an emergency.

PRESENTATION OF THE INVENTION

This object is attained a method of sending an emergency message, whereby the emergency message is automatically sent to a remote station after the emergency occurred, wherein after the emergency occurred but before the emergency message is sent, a test is performed as to whether at least one sound detection device and/or at least one sound emission device is still operating, and that in addition to the emergency message the result of the operating test is also transmitted to the remote station.

If according to this method a test is performed after the emergency occurred but before the emergency message is sent, whether at least one sound detection device and/or at least one sound emission device is/are still operating, and the result of the operating test is also transmitted to the remote station in addition to the emergency message, it ensures that the remote station is informed of the condition of the sound emission and sound detection devices. This information then places the remote station for example into a position where it can use the still available devices for effective communication.

A particularly advantageous use of existing devices for sound emission and sound detection is provided if one type of device fails and at least two devices of the other type are available, so that at least one of them can be used instead of the device that was determined to be defective or no longer available.

If only one sound emission or sound detection device is operating, a voice communication is possible if this one device is used as the intercom.

Even if the sequence in which the sound emission and sound detection devices are tested is not significant for the subsequent reception of the communication, a sequence simplifies the test of the sound emission devices if we start with the fact that for example only one sound detection device is installed in an automobile, perhaps in the form of a microphone, but a number of loudspeakers which can be used for sound emission are available, so that testing can be omitted if there is one operating microphone since it can be assumed that all the loudspeakers have probably not failed.

If it also desirable to ensure that in the presence of an operating microphone at least one of the loudspeakers is also able to transmit sound events, the sound emission devices as well as the sound detection devices can be tested by applying a test voltage. It is significantly easier if the test of the ability of the sound emission devices to operate can simplify, or of the devices chosen for sound emission is exclusively acoustical, whereby at least one sound signal is sent to the devices used for sound emission, and its reception is evaluated as an index of an operating sound emission. The acoustical test of the sound emission devices furthermore has the advantage that they are tested together, since the use of several sound emission devices in an emergency operation does not necessarily require all the sound emission devices to be operating. Finally the acoustical test has the advantage over the purely electrical test in that with the acoustical test for example loudspeakers, which have still complete contact of the voice coil but a torn diaphragm, can also be determined to be defective.

Since according to the invention the sound detection and sound emission devices can still be used very flexibly to maintain communication during an emergency situation, it is possible for the function and/or quality of the devices to change. To prevent misunderstandings in connection with the function and/or quality, sending information which explains the particularities of the respective operation via the respective sound emission devices is not only advantageous in connection with the operating mode.

BRIEF PRESENTATION OF THE FIGURES

Where:

BEST MODE FOR CARRYING OUT THE INVENTION

The invention will now be explained in greater detail by means of the figures.

Figure 1:
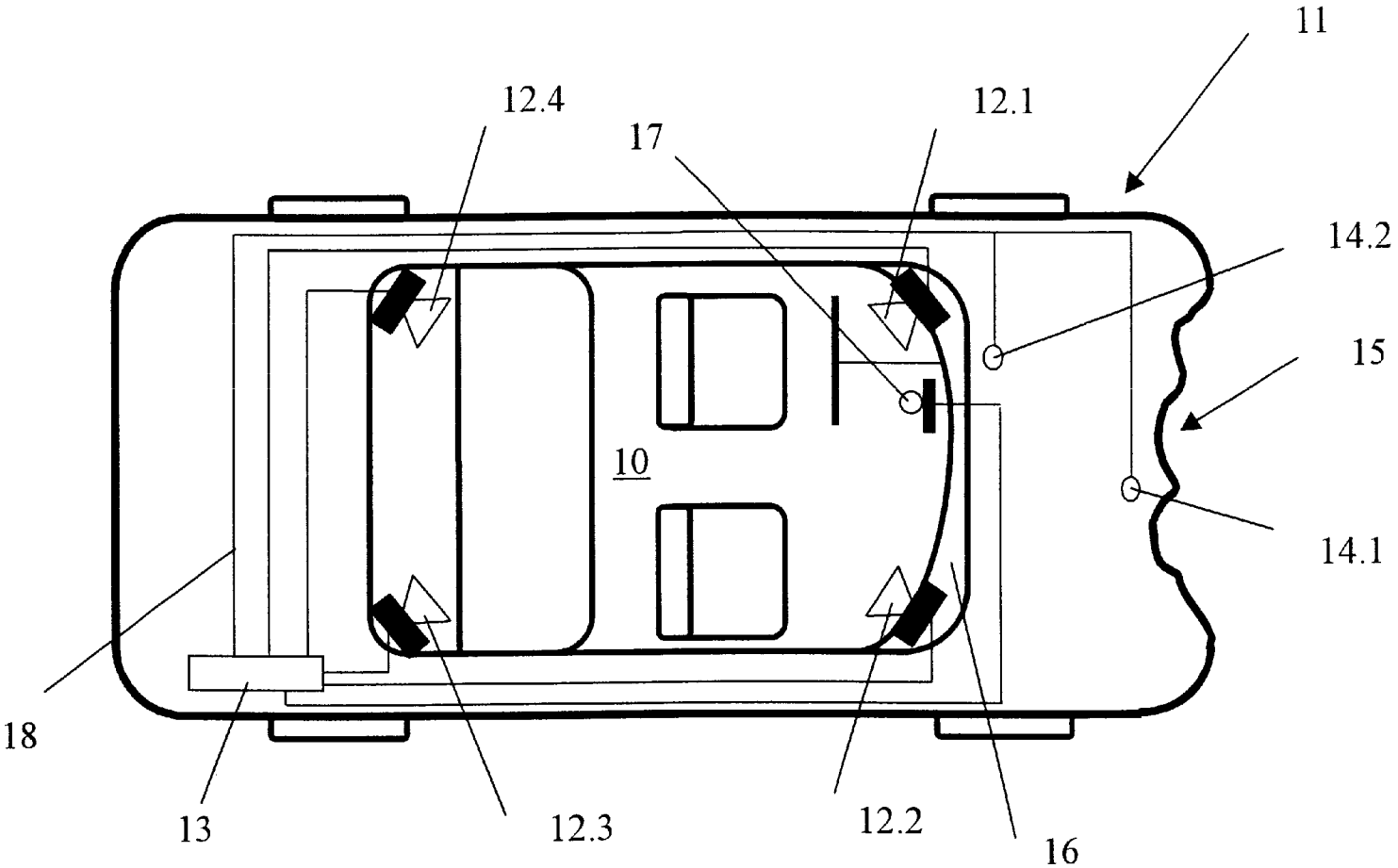
FIG. 1 is a (schematic) top view of the inside of an automobile.

FIG. 1, which is a simplified top view of the inside 10 of an automobile 11, shows that this automobile 11 has four sound emission devices 12 in the form of loudspeakers. It can also be seen that the automobile 11 is equipped with a car telephone 13. This car telephone 13 uses the existing four sound devices for telephone conversations, and otherwise to reproduce the sound of the car's music equipment which uses the sound emission devices 12.

The illustrated embodiment also has two crash sensors 14.1 and 14.2 which are connected to the car telephone 13. One of the crash sensors 14.1 is located in the front 15 of the automobile 11, and the other crash sensor 14.2 in the dash-board area 16. While the crash sensor 14.1 informs the car telephone 13 that the front 15 has been damaged, the crash sensor 14.2 is only activated and sends a signal to the car telephone 13 if one of the air bags in the dash-board 16 (not shown) is activated. In another not illustrated embodiment, a crash sensor can be connected to the seat belt or belts.

Depending on the configuration of the car telephone 13, it can be constructed so that every signal sent by the crash sensor 14.1 or 14.2 to the car telephone 13 triggers the transmission of an emergency message stored in the car telephone 13. However, to limit the transmission of emergency messages to those which are actually due to an emergency situation, the car telephone 13 may be designed so that it only transmits an emergency message after it receives a number of signals from the crash sensors 14.1 or 14.2.

FIG. 1 further shows that the automobile 11 is equipped with a sound detection device 17. This sound detection device 17 is a microphone and is located near the steering wheel 18. Even if the embodiment illustrated in FIG. 1 uses only one sound detection device 17, another not illustrated embodiment could have a number of microphones installed on the inside 10 of the automobile 11.

The irregular line of the front 15 of the automobile 11 indicates that the front 15 of the automobile 11 was damaged during an accident. Because of this front 15 damage, it is assumed that each of the two crash sensors 14.1, 14.2 has sent a signal to the car telephone 13 via the connection line 18. If the car telephone 13 receives such a signal and before it transmits an emergency message stored for example in the car telephone 13, it checks to determine which sound detection device 17 or sound emission devices 12 are still operating. In the embodiment shown in FIG. 1 this takes place by sending a test current to measure the resistance of the sound emission devices 12 as well as the sound detection devices 17. If this shows that in the case illustrated in FIG. 1 only the two sound emission devices 12.1, 12.2 have lost their ability to operate because of the accident, in addition to the emergency message to the remote station, a message can be sent that normal communication is possible with the passengers for technical reasons, because the sound emission devices 12.3, 12.4 and the sound detection device 17 are operating.

However in order to obtain more detailed information about the ability of the sound emission devices 12 to operate, after determining that the sound detection device 17 is able to operate, a sound signal can be sent to the sound emission devices 12. If this sound signal is received by the sound detection device 17, it proves that a sound emission device 12 is able to operate. This manner of determining the ability of sound emission devices to operate is particularly advantageous because it can also be used to determine defective or clamped loudspeaker diaphragms.

Figure 2:
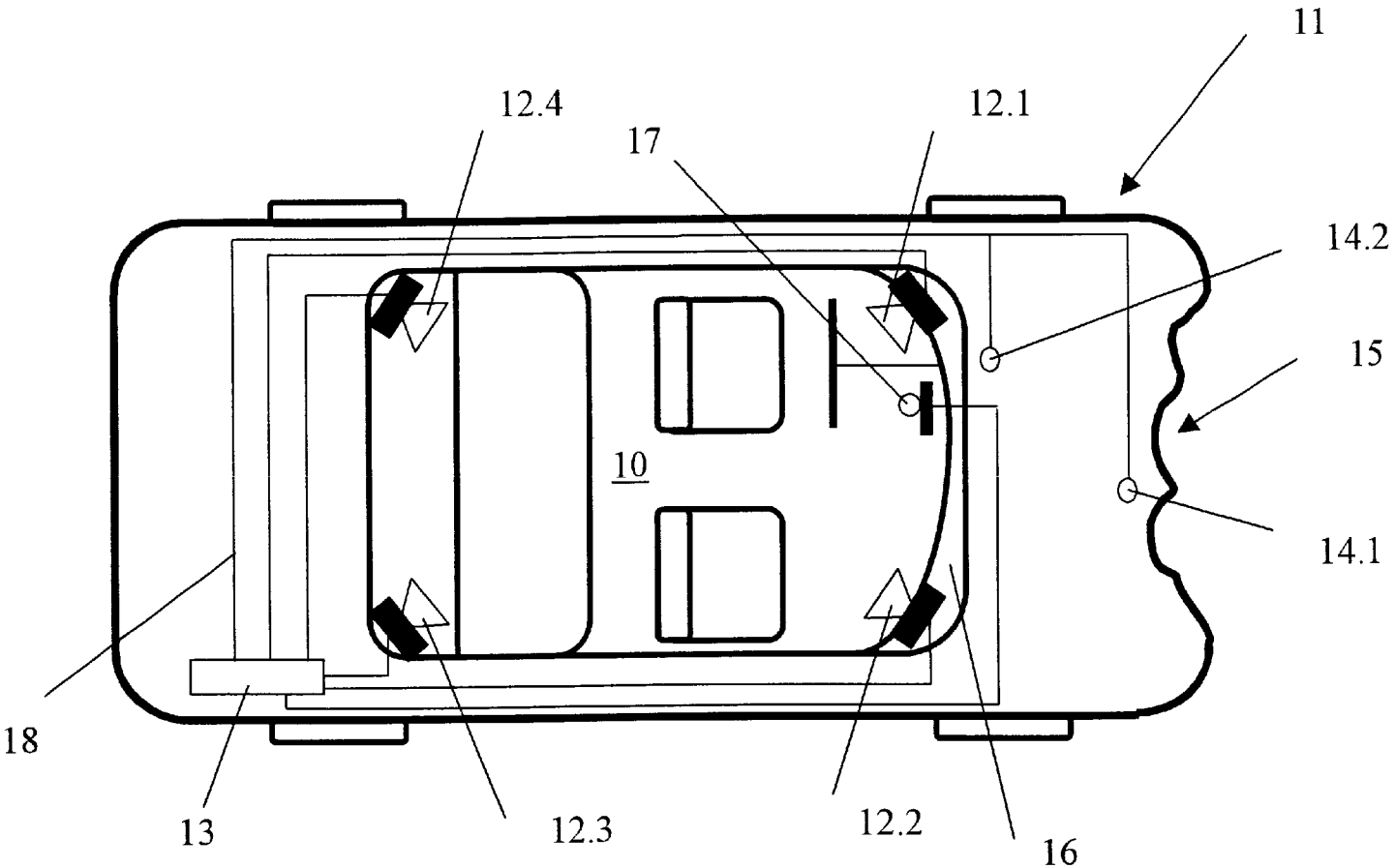
FIG. 2 is a further illustration of FIG. 1.

FIG. 2 shows an embodiment in which, in contrast to the embodiment according to FIG. 1, the sound detection device 17 has also lost its ability to operate following an accident, but the sound emission devices 12.2 to 12.4 remain operative. Since in the embodiment shown in FIG. 2 the ability of the sound detection device 17 to operate is tested before that of the sound emission devices 12, the determined failure of the sound detection device 17 requires using one of the still operating sound emission devices 12.2 to 12.4 for the sound detection. However, since the sound emission devices 12 only have a very modest ability to function when they are used to detect sound, this operating method must ensure that in each case only those operating sound emission devices 12 are used as sound detectors 17 which are as close as possible to the person with whom a communication is desired. Since in most automobile 11 trips only the front seats are occupied, of the operating sound emission devices 12.2 to 12.4 in the embodiment in FIG. 2, the sound emission device 12.2 is used as the sound detector. In order to inform the remote station of the situation after an accident, since the embodiment in FIG. 2 uses the sound emission device 12.2 as the sound detector, the information that a normal communication is possible for technical reasons can also be sent in addition to the emergency message. Since according to FIG. 2 a sound emission device 12.2 is used as the sound detector, the message about the situation can be modified to inform the remote station of this operating condition.

Figure 3:
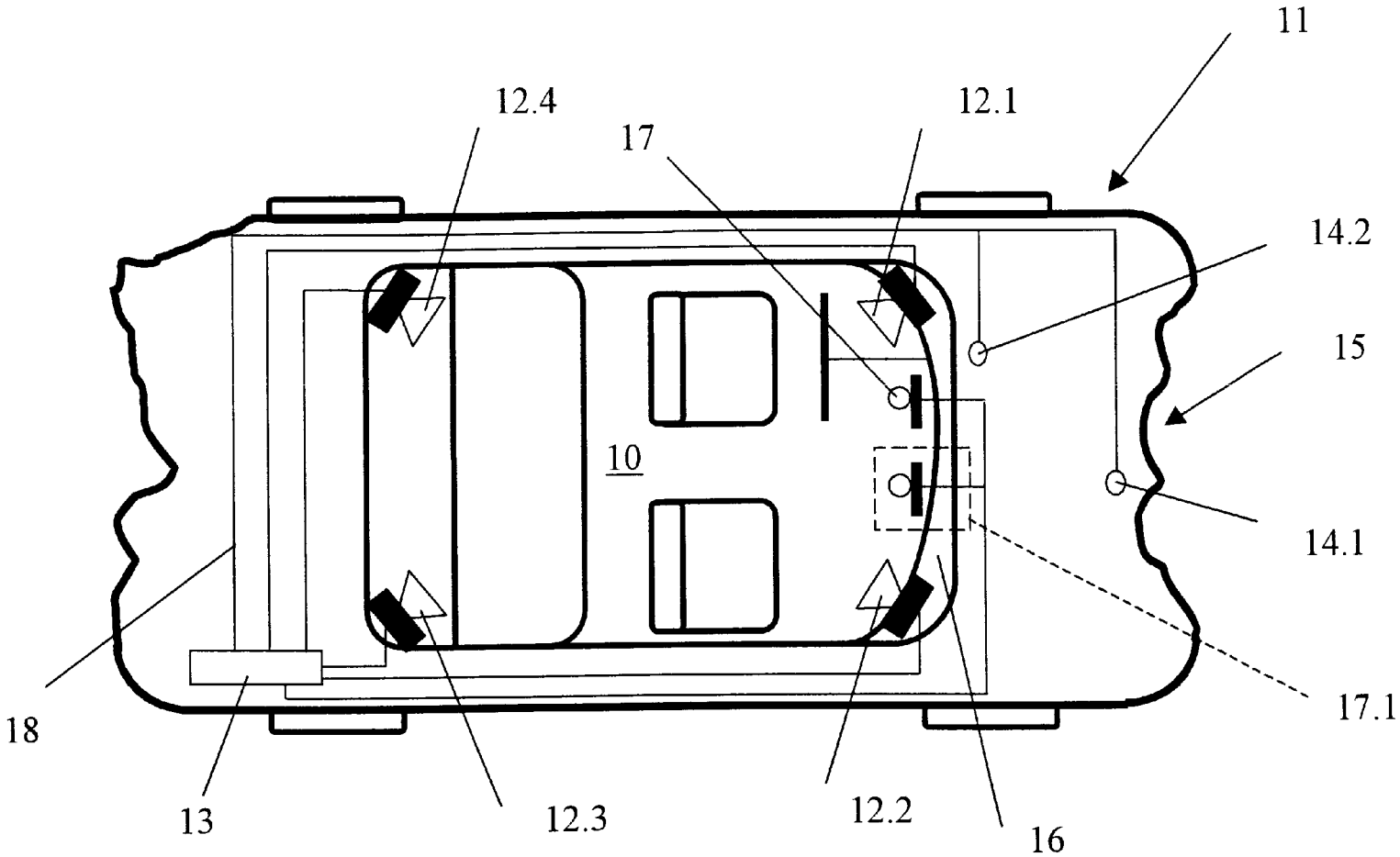
FIG. 3 is still another illustration of FIG. 1.

FIG. 3 shows an automobile 11 which has suffered a significantly greater degree of damage in an accident than the automobiles 11 in FIGS. 1 and 2. The testing step also determined that all sound emission devices 12 have failed and only the sound detection device 17 is able to operate. For that reason, in order to communicate with the remote station, the sound detection device 17 is used as an intercom. This means that the sound detection device 17 is used alternatingly as a microphone and a loudspeaker. Depending on the configuration, the switching between the two operating modes can either take place automatically or be controlled by the remote station. Since the intercom operation differs considerably from the normal two-way communication during which speaking and listening take place simultaneously, at least in this case the passengers in automobile 11 should be informed about any peculiarities in connection with the intercom operation. Considering that an accident is always an unusual situation, in all instances where any kind of voice communication with the remote station is still possible, corresponding information should be provided to the passengers.

FIG. 3 shows another sound detection device 17.1 to further explain the invention. If all sound emission devices 12 are defective after an accident and only the two sound detection devices 17, 17.1 are able to operate, the sound detection device 17.1 can be used as the sound emitter to maintain two-way communication.

What is claimed is:

1. A method of sending an emergency message, whereby the emergency message is automatically sent to a remote station after the emergency occurred, characterized in that:

after the emergency occurred but before the emergency message is sent, a test is performed as to whether at least one sound detection device 17 and/or at least one sound emission device 12 is still operating, and in addition to the emergency message the result of the operating test is also transmitted to the remote station, wherein the test is triggered by the emergency, and wherein the at least one sound detection device 17 and/or the at least one sound emission device 12 allow remote communication at least by voice.

2. A method as claimed in claim 1, characterized in that if inoperative sound detection devices 17 are found, but at least two sound emission devices 12 are still operating, one of these devices is used as a sound detection device.

3. A method as claimed in claim 1, characterized in that if inoperative sound emission devices 12 are found, but at least two sound detection devices 17, 17.1 are still operating, one of these devices is used as a sound emission device.

4. A method as claimed in claim 1, characterized in that if only one sound detection device 17 or only one sound emission device 12 is operating, the operating device is used as an intercom.

5. A method as claimed in claim 3, characterized in that the operating test of the sound detection devices 17 or the sound emission 12 devices chosen to be sound detectors, takes place before the operating test of the sound emission devices 12 or the sound detection devices 17 chosen to be sound emitters.

6. A method as claimed in claim 5, characterized in that the test of the ability to operate the sound emission devices 12 or the sound detection devices 17 chosen to be sound emitters is exclusively acoustical, in that at least one sound signal is sent to the devices used for sound emission 12 (17.1) and its reception by the sound detection device 17 is evaluated as an index of an operating sound emission.

7. A method as claimed in claim 6, characterized in that information about the respective condition and operating mode of the device is provided by the respective sound emission devices 12.

8. A method as claimed in claim 1, characterized in that the operating test of the sound detection devices 17 or the sound emission 12 devices chosen to be sound detectors, takes place before the operating test of the sound emission devices 12 or the sound detection devices 17 chosen to be sound emitters.

9. A method as claimed in claim 1, characterized in that the test of the ability to operate the sound emission devices 12 or the sound detection devices 17 chosen to be sound emitters is exclusively acoustical, in that at least one sound signal is sent to the devices used for sound emission 12 (17.1) and its reception by the sound detection device 17 is evaluated as an index of an operating sound emission.

10. A method as claimed in claim 1, characterized in that information about the respective condition and operating mode of the device is provided by the respective sound emission devices 12.

11. The method of claim 1, wherein:

the emergency message is sent from a vehicle to the remote station, and the remote communication utilizes a wireless radio system.

* * * * *